United States Patent [19]

Lizzi et al.

[11] Patent Number: 5,061,941

[45] Date of Patent: Oct. 29, 1991

[54] COMPOSITE ANTENNA FOR ELECTRONIC ARTICLE SURVEILLANCE SYSTEMS

[75] Inventors: Phillip J. Lizzi, Deptford, N.J.; Richard A. Shandelman, Levittown, Pa.

[73] Assignee: Checkpoint Systems, Inc., Thorofare, N.J.

[21] Appl. No.: 473,586

[22] Filed: Feb. 1, 1990

[51] Int. Cl.[5] ..... H01Q 11/12

[52] U.S. Cl. ..... 343/742; 343/856; 340/572

[58] Field of Search ..... 343/742, 741, 744, 842, 343/867, 743, 856; 340/572

[56] References Cited

U.S. PATENT DOCUMENTS

| | | | |
|---|---|---|---|
| 4,243,980 | 1/1981 | Lichtblau | 343/742 |
| 4,260,990 | 4/1981 | Lichtblau | 343/742 |
| 4,751,516 | 6/1988 | Lichtbau | 343/741 |
| 4,866,455 | 9/1989 | Lichtbau | 343/742 |
| 4,872,018 | 10/1989 | Feltz et al. | 343/742 |

*Primary Examiner*—Michael C. Wimer
*Assistant Examiner*—Hoanganh Le
*Attorney, Agent, or Firm*—Albert L. Free

[57] ABSTRACT

A composite antenna system for an article surveillance system, in which a plurality of differently-phased loop antennas are supplied with different currents to provide desired positioning of peaks and nulls in the near-field strength, and to produce near-zero far-field strength, as desired. In one preferred form, a smaller loop is placed near the floor and a larger loop placed above it, with the lower loop supplied with a correspondingly higher-intensity of current to provide an enhanced near-field strength near the floor, while still maintaining far-field cancellation.

10 Claims, 2 Drawing Sheets

COMPOSITE ANTENNA FOR ELECTRONIC ARTICLE SURVEILLANCE SYSTEMS

FIELD OF THE INVENTION

This invention relates to composite antennas suitable for use in electronic article surveillance systems, and particularly to such antennas which produce a strong local field in the immediate vicinity of the antenna to accomplish article detection, but which produce near zero or very weak far fields so as not to interfere with the operation of other electronic apparatus.

BACKGROUND OF THE INVENTION

In certain known types of electronic systems, particularly those designed for electronic article surveillance, it is known to provide a composite antenna comprising two or more antennas coupled to each other in one way or another, and to which signals from a transmitter are supplied so as to produce an induction field adjacent the composite antenna which is sufficiently strong to detect the presence near the antenna of predetermined types of objects; in order to avoid the production of relatively strong far fields which might interfere with the operation of other electronic apparatus, it is known to design such composite antennas so that their net effect at positions remote from the antennas is substantially zero, or at least insufficient to cause any serious problem.

A particular type of system with respect to which the present invention will be described in detail is an electronic article surveillance system of the type in which a tag or other electronically detectable marker is secured to articles to be protected against unauthorized removal from protected premises, and in which the exits from the premises through which the goods would normally be removed are irradiated by a transmitted field from an antenna system; the response of the marker to such transmitted fields is then detected by an appropriate nearby receiver. In one wellknown form of such system, the marker is a tag circuit on a small tag secured to the article to be protected, which circuit resonates in response to the signals transmitted by the antenna, thereby producing return signals at the receiver which indicate the presence of the tag and the article to which it is attached.

In order to provide the desired far-field cancellation, it is known to constitute the antenna of a plurality of loop antennas the planes of which are substantially parallel and adjacent but displaced from each other, and in which the direction of transmitter current flow with respect to the environment is opposite in different loops, so that the remote fields produced at any remote point by the loops are opposite in phase with respect to the environment. Using such a composite antenna, it has been found possible to cancel the far field substantially completely by suitable choice of the cross-sectional areas and numbers of turns in the several loop antennas.

In one simple form, for example, such a composite antenna may comprise two loop antennas formed from the same continuous wire by, in effect, twisting the two halves of the antenna by 180° to produce a configuration analogous to a FIG. 8; in such an antenna, the directions of flow of the currents at any instant are opposite with respect to the environment, and if the two loops have the same number of turns and the same area, substantially complete cancellation of far fields will be effected. More than two such loops may be employed in accordance with the prior art, with the same intensity of current and the same number of wires in each loop, and with the total area of the loops operating in a given phase equalling the total area of the loops operating in the opposite phase.

Although the far-field effects of the composite antenna are then substantially cancelled, the magnetic "near-fields" due to the respective loop antennas may differ substantially from each other, depending upon exactly where the article to be detected is located. For example, if the article is located nearly in alignment with the center of one of the loops and near it, it will be affected primarily by the transmitter signal radiated by that loop and if it is aligned with, and near, the center of another of the loops, it will be affected primarily by the transmitter signal in that loop. Thus, cancellation of the near field will not occur in either of the latter specified circumstances , and in fact near-field cancellation normally occurs only in a relatively small region. It is the non-cancellation of the near field in most of the region near the transmitter antenna which permits detection of the protected object, as is desired.

However, as noted above, in general there will be some limited regions in the RF induction near-field adjacent the antenna in which the transmitted signal components from the various loops of the composite antenna do substantially cancel each other; for example, in the case of two loops of equal area and equal but opposite current intensity, each using the same number of wires in its loop, a substantial null in the near field will exist in and near a plane at right angles to the plane of the loops and passing through a mid-point between them.

While such near-field nulls cannot be completely eliminated, it has been possible to control to some extent their locations. The positions at which such null regions can best be tolerated depends on the particular application of the system, and it is generally desirable to be able to design the antenna system to avoid such nulls at certain positions where article-detection is important.

For example, in the case of vertically disposed antenna loops positioned one above the other adjacent the path along which customers leave protected store premises, it is possible to utilize one loop antenna operating in a particular phase and of large cross-sectional area extending, for example, from two to five feet above the floor, so that articles removed past the antenna in most of this height range will be readily detected, and to utilize an oppositely-phased loop above and an oppositely phased loop below the principal central antenna to provide the desired far-field cancellation as well as additional detection at very low and very high levels. In such case, for example, the near-field null regions will be limited to positions near the two foot and five foot levels, so that an article hidden on the person or carried in a bag above the knees and below the shoulders, or in a very high or very low position, is likely to be detected. However, this may not be the optimum position for the near-field nulls in all cases, and the length of wire used in the antenna also may not be optimum; it should be recognized that in the type of systems specifically described hereinafter, the more wire length utilized in the antenna, the more undesired resonant frequencies arise in the antenna system, and if too much wire is employed such resonances may, in fact, lie within the operating bandwidth of the wide-bandwith RF EAS system and interfere with its operation. Accordingly, it is also generally desirable to minimize the number of loops and the number of turns per loop in the antenna system.

Aside from the problem of the location of the null regions, there is the problem of controlling the configuration of the net near-field strength adjacent the antennas so that the higher field strengths occur in the region where they are most helpful. It will be understood that tag circuits in some locations and orientations near the antennas respond less strongly to the radiated near field than do tag circuits in other location and/or orientations, and therefore require higher near-field strengths to assure their detection. Increasing the radiated power proportionally in all directions so as to assure detection of such hard-to-detect tags would be wasteful of power, and likely to result in unacceptably high remanent far-field strengths, even though they may be minimized by the cancellation technique described above. What is desirable is to enhance selectively the field strengths in the regions where tag detection is expected to be difficult.

Unfortunately, as pointed out above, one is constrained, in varying the loop areas and the number of turns on the various loops, by the need to maintain adequate far-field cancellation and the desirability of using only integral numbers of turns in the loops and as little antenna conductor length as possible.

It will therefore be appreciated that there are a variety of considerations involved in selecting the optimum antenna system for any particular application, not all of which can readily be met by mere selection of the areas of the loops, the number of loops and the number of turns in each loop, nor even by selection of the geometric shape and positioning of the loops.

Accordingly, it is an object of the present invention to provide a new and useful composite antenna system of the type utilizing a plurality of antennas to produce a substantial net near field adjacent the antennas, but very low or near-zero net far-field strengths at positions remote from the antenna.

Another object is to provide such a composite antenna which provides a greater choice of design parameters than do previously-known composite antennas.

A still further object is to provide such a composite antenna which enables concentration of the field intensity in regions where they are most needed to detect hard-to-detect tags, and which also enables control of the location of the near-field null regions, without requiring an excessive number of antenna loops or number of turns in each loop and without producing excessive net far-field strengths.

SUMMARY OF THE INVENTION

These and other objects and features of the invention are attained by the provision of a composite antenna comprising a plurality of adjacent antennas, and means for feeding the antennas with transmitter signal currents of the same form, but of predetermined different relative intensities and directions with respect to the environment, so that substantial far-field cancellation is achieved together with control of the positioning of the peaks and nulls of near-field strength. The requisite different intensities of antenna currents are preferably provided by using different transformer couplings of the transmitter signals into the several antennas, the transformer ratios being selected to provide the desired relative strengths of currents in the respective antennas.

More particularly, assuming the individual antennas are loop antennas, and designating the cross-sectional area of each loop by A, the number of turns in each loop by N and the current in each loop by I, in order to achieve far-field cancellation it is desirable that the sum of the products ANI for the loops in which the current flows in a first direction with respect to the environment equal the product ANI of the loops in which the current flows in the opposite direction with respect to the environment or, more generally, that the sum of the products $ANI_v$ for all antennas be substantially zero, where $I_v$ is the vector value of the current, taking into account its instantaneous direction with respect to the environment. By using different values for the currents in the loops, the sum of the products AN for one phase of antenna need not be the same as the sum of the products AN for the oppositely-phased loops, and thus one has a much greater freedom of design with respect to the loop area A and the number of turns N which can be employed to produce far-field cancellation than was previously the case, and the antenna parameters can therefore be more widely varied to achieve the desired positioning of near-field peaks and nulls.

In one preferred embodiment described in detail hereinafter, the transmitter signal is passed through the primary of a transformer, and respective secondaries are placed in the various loops, the ratios of the turns between the transformer secondaries and primaries being different for at least some of the loops, so that the corresponding currents induced in at least some of the loops are unequal in intensity. In another useful form of the invention, the transmitter signal may be injected into one of the loops through a transformer coupling and transferred from that loop to one or more other loops by transformer coupling, again using transformer ratios such that the current in at least some of the loops differ from each other. Direct coupling, without transformers, may also be used. Specific, especially useful, embodiments of the invention are set forth and described in detail hereinafter.

BRIEF DESCRIPTION OF FIGURES

These and other objects and features of the invention will be more readily understood from a consideration of the following detailed description, taken with the accompanying drawings, in which.

DETAILED DESCRIPTION OF SPECIFIC EMBODIMENTS

Referring now to the specific embodiments of the invention shown in the accompanying drawings by way of example only, and without thereby limiting the scope of the invention, there will first be described a number of previously-known general antenna arrangements, to which the present invention will then be contrasted.

Figure 1:
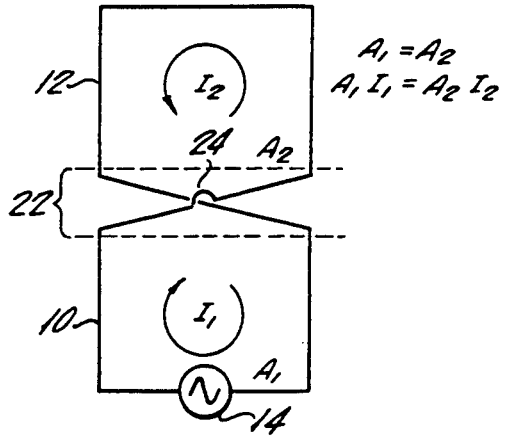
Fig. 1 (PRIOR ART)
FIG. 1 is a schematic representation of a previously-known composite loop antenna.

FIG. 1 shows a composite antenna employing two identical single-conductor loops 10 and 12 end-driven by a transmitter signal generator 14, which typically is the transmitter of an electronic article surveillance system; the signal is generally a sinusoidal RF signal of, for example, about 8.2 MHz, varied ±10%. It is noted that in this example the loops 10 and 12 are mutually twisted with respect to each other, so that the current flows clockwise in loop 10 at the time when it is flowing counterclockwise in loop 12, for example. Since both loops are different parts of the same series conductor, the current intensity $I_1$ in the lower loop is the same as the current intensity $I_2$ in the upper loop, and is in the same direction along the conductor but of opposite polarity with respect to the environment. Therefore, when one loop is radiating, in a given direction, a field corresponding to one-half of the sinewave, the other loop is radiating a field corresponding to the other half of the sinewave in that same direction, so that at a distance the far-field components from the two loops are 180° out of phase and substantially cancel each other. Designating the area of loop 10 as $A_1$, and that of loop 12 as $A_2$, far-field cancellation is obtained when the scaler products $I_1A_1$, and $I_2A_2$ are equal.

In FIG. 1, the planes of the two loops are parallel to each other, and to the path along which the persons carrying articles are constrained to travel. Accordingly, an article carried out at the height of the center of the lower loop 10 will experience a strong near-field induction field, as will one which is carried at a height corresponding to the middle of the upper loop 12. However, there is a detection null region 22 near a horizontal plane through the cross-over 24 of the two loop antennas, in which null region the contributions to the total net field due to the two loops are substantially equal and, being of opposite polarity, tend to cancel each other. Accordingly, articles carrying tell-tale tag circuits in this null region are not subject to a substantial net field, and since this null region is at a height where objects may be incidentally or intentionally carried, some unauthorized articles may be carried out past the exit without detection.

Figure 2:
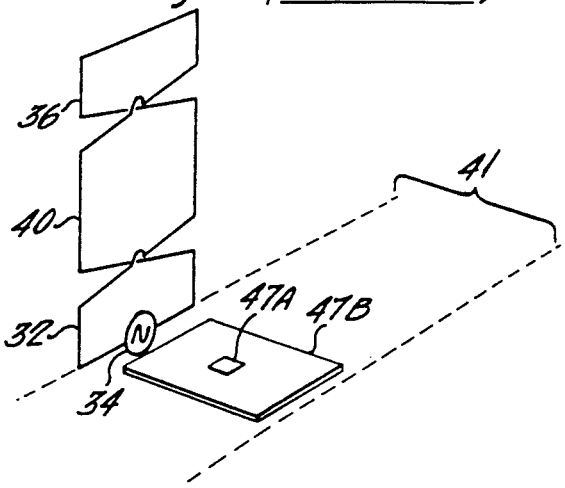
Fig. 2. (PRIOR ART)
FIG. 2 is a schematic diagram of another composite loop antenna of the prior art positioned, at the exit from protected premises.
Figure 3:
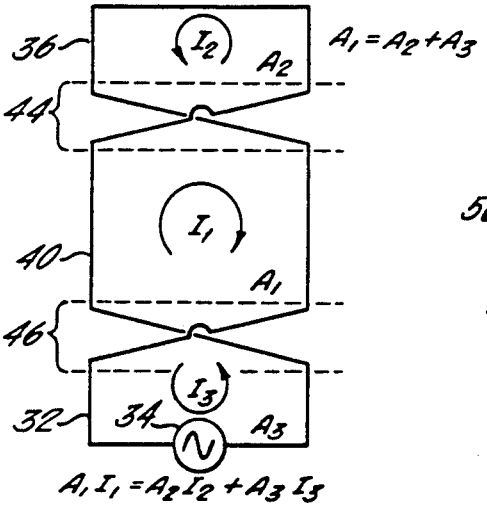
Fig. 3. (PRIOR ART)
FIGS. 3 is another schematic view of the antenna of FIG. 2.

FIGS. 2 and 3 shows schematically a three-loop system of the prior art in which the lower loop 32 is driven by the RF transmitter 34, the wires of all loops constituting a common serial conductor so that the current is the same in all loops. However, the top loop 36 and bottom loop 32 experience currents which flow in opposite directions in space with respect to the current in center loop 40 at any given time, so that the top and bottom loops provide cancellation of the far field component due to the center loop; to accomplish this, the top and bottom loops have loop areas $A_2$ and $A_3$ each about one-half the area $A_1$ of the center loop so that $A_2I_2+A_3I_3=A_1I_1$. The number of turns N is one for both loops.

In this case the near-field nulls occur in the general regions designated as 44 and 46, at heights near the two loop cross-overs. This does provide a relatively large central region in which the inductive near field is strong and articles are readily detected, but it leaves the two substantial null regions in positions such that some articles may be removed through them without detection.

Furthermore, if the tag 47A (FIG. 2) is positioned flat and nearly against the floor as it passes the antenna system it will not produce a response large enough to be readily detected, and for that reason a separate floor-mat antenna 47B may be necessary to accomplish detecting the tag.

Figure 4:
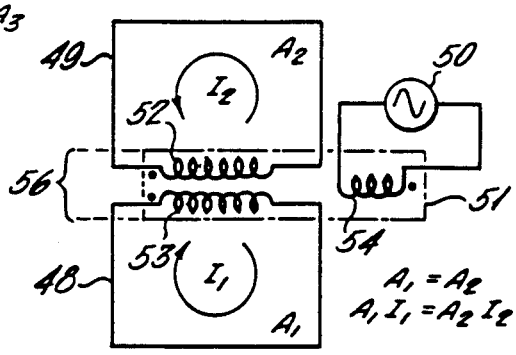
Fig. 4. (PRIOR ART)
FIGS. 4–6 are schematic diagrams of other previously-known composite loop antennas.

FIG. 4 shows schematically another known arrangement for an EAS antenna using single-conductor two loops 48 and 49 of respective areas $A_1$ and $A_2$, one loop directly above the other, the loops having equal areas and being fed with equal currents from transmitter signal source 50 via a transformer 51. As indicated by the dots associated with each transformer coil in FIG. 4, the secondary coils 52 and 53 are coupled to primary coil 54 of transformer 51 in the same polarity, so that the currents in the two loops are opposite with respect to the environment. Again, $A_1I_1,=A_2I_2$ so that far-field cancellation is obtained. However, this arrangement produces a substantial centrally-located near-field null region 56.

Figure 5:
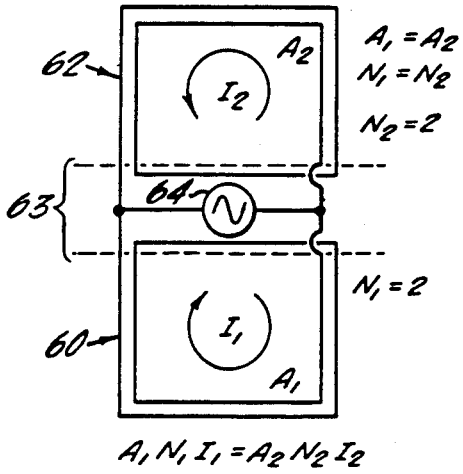
Fig. 5. (PRIOR ART)

FIG. 5 shows schematically another known type of EAS antenna using two loops of equal areas and two turns per loop, driven from a transmitter source 64 connected to their adjacent central ends. Designating the numbers of turns per loop as $N_1$ and $N_2$ for loops 60 and 62 respectively, $A_1\ N_1\ I_1 = A_2\ N_2\ I_2$ to produce far-field cancellation. However, a null region 63 again exists near the central horizontal plane of the antenna, and the only available adjustment of the antenna to change the null region without affecting far-field cancellation is to make one loop of a smaller area, but with more turns. This is still limiting with respect to design variation, especially since complete turns are necessary: for example, one cannot use 2.3 turns. In addition, to avoid interfering parasitic resonances it is desirable to keep the number of turns to a minimum.

Figure 6:
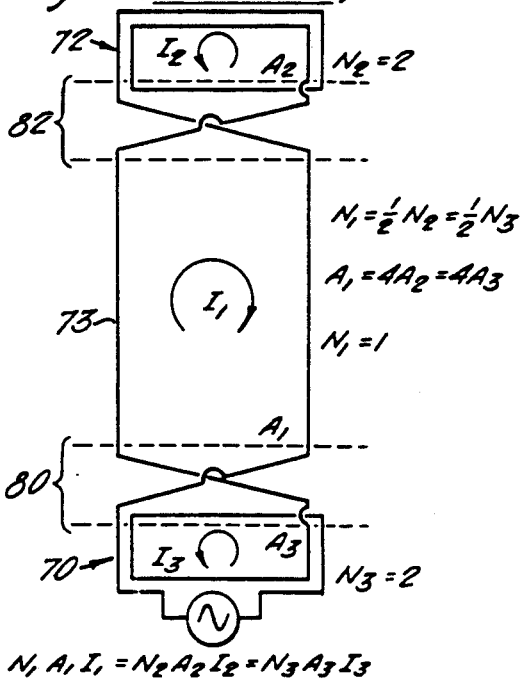
Fig. 6. (PRIOR ART)

FIG. 6 shows another arrangement of the prior art utilizing three loops, the top and bottom loops 72 and 70 each having two turns and the central loop 73 having a single turn; the top and bottom loops each have an area substantially ¼ that of the center single-turn loop ($A_1=-2A_2+2A_3$), but $N_2$ and $N_3$ are each equal to $2N_1$, so that $N_1A_1I=N_2A_2I_2+N_3A_3I_3$. Such an arrangement has null regions substantially as shown at 80 and 82, and suffers again not only from the drawback that any adjustment by changing turns can only be done one complete turn at a time, but also that any additional turns which are necessary tend to lower the parasitic resonance frequencies in the antenna, which frequencies may then fall within the frequency band of operation of the system and produce undesired interfering effects.

The FIGS. 1–6 described above illustrate configurations of antenna systems using different numbers of loops, different numbers of turns per loop and different areas of loops, but all constrained by the fact that to produce near-zero far-field strength, the sum of the product AN for all loops radiating in one phase in a given antenna system must be substantially equal to the sum of the product AN for all loops of the opposite phase in the same system.

Figure 7:
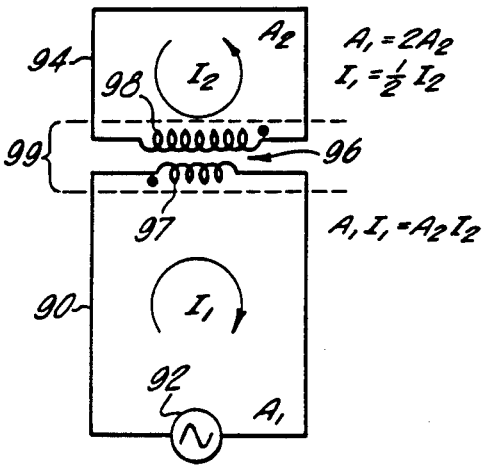
FIGS. 7–9 are schematic diagrams of various composite loop antennas according to this invention.

FIG. 7 shows one composite antenna according to the present invention in which different currents are used in the different loops, preselected to produce the desired far-field and near-field effects. In this example the lower loop 90 is fed with transmitter signals from transmitter source 92, and transfers signal current to the upper loop 94 by way of the transformer 96, the primary 97 and secondary 98 of which are in opposite polarity (as indicated by the dots adjacent each winding) and in other than a one-to-one ratio, so that the currents in the two loops are opposite with respect to the environment and differ in strength in a predetermined manner. For example, if as shown the only difference between the two loops is that the lower loop has twice the area of the upper one, the transformer ratio is 1:2 so that the upper loop then is provided with twice as high a current intensity as the lower loop, resulting in the same value of ANI and hence producing far-field cancellation. Such far-field cancellation is achieved even though the lower loop is of greater area than the upper loop; the near-field null region of the antenna is then as represented at 99.

Figure 8:
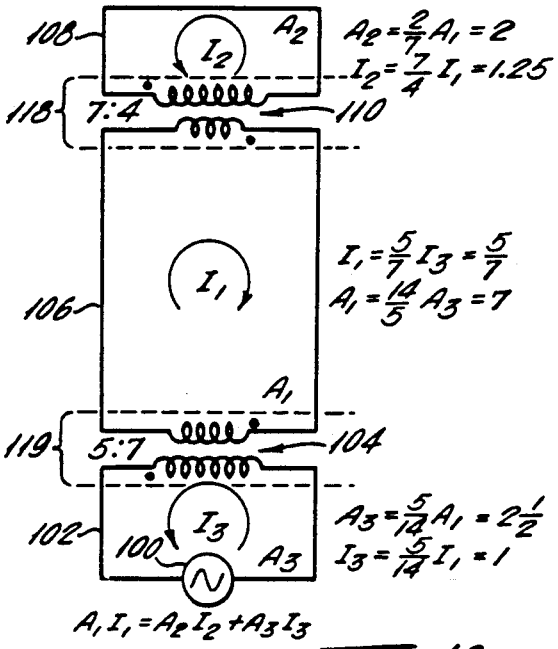

A three-loop system according to the invention is shown in FIG. 8, wherein the transmitter signal source 100 directly supplies the lower loop 102 with current which is transformer-coupled by transformer 104 into the central loop 106 in the opposite polarity, and thence into the upper loop 108 in the polarity opposite to the current in the central loop by means of transformer 110. The middle loop may, for example, have an area $A_1$ of 7; the top loop may, for example, have an area 2/7 that of the center loop, i.e. 2, and the lower loop may have an area 5/14 of the center loop, i.e. 2¼. In this case, if the field from the top loop is to equal that from the bottom loop, the top loop will have 7/4 the current of the middle loop and the bottom loop will have 5/14 the current of the middle loop. Thus the top transformer will have a step-up ratio of 7:4, and the lower transformer a step-down ratio of 5:7. If the current in the lower loop is 1, for example, this will produce a top-loop current of 1.25 and a middle-loop current of 5/7; AI for each of the top and bottom loops will then be 2.5, and the middle loop value for AI will be 5 with a current of opposite polarity to the top and bottom loop currents. This will again provide the desired far field cancellation, and null regions as shown at 118 and 119.

Figure 9:
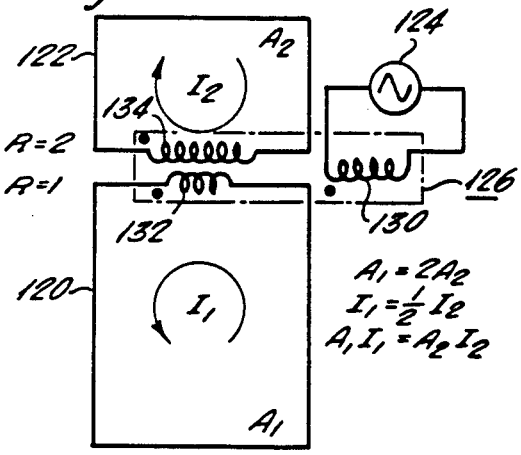

FIG. 9 shows a variation of the invention in which the two loops 120 and 122 are separate, and in which different currents are induced in them in response to the transmitter signal from source 124 by way of the transformer 126, of which 130 is the primary and 132 and 134 are secondaries in the respective loops 120 and 122. The induced currents in the two loops again are of opposite direction with respect to the environment to produce opposite polarities of radiated fields. Where for example the area $A_2$ of the top loop is 3/8 that of the lower loop, the current in the top loop is preferably about 8/3 that in the lower loop, provided by a transformer ratio of 8:3, so that $A_1N_1I_1 = A_2N_2I_2$.

In general, in order to achieve far field cancellation, the summation of the product ANI for all loops of one phase should substantially equal the summation of the product ANI for all loops of the opposite phase, and by the present invention considerably more flexibility in antenna design to achieve the desired null locations is provided by using predetermined different currents in the various loops, so that the designer is not limited to use of one value of the product AN.

Figure 10:
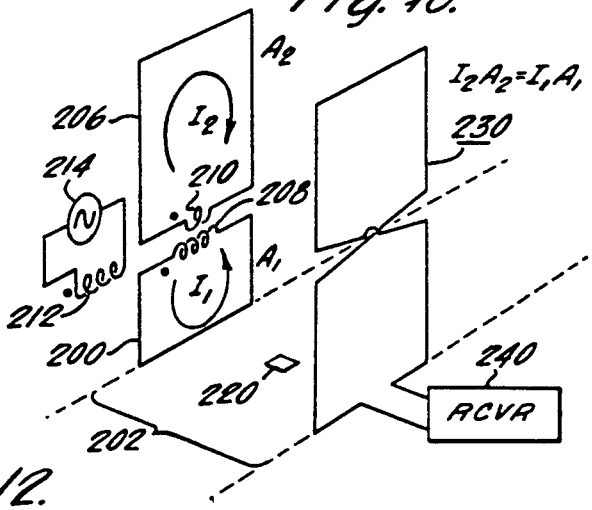
FIG. 10 is a schematic diagram of a composite loop antennas according to this invention designed to overcome a specific problem arising in one of its applications.

FIG. 10 shows, by way of example, one specific arrangement which is advantageous in certain applications of an EAS system. In this case the composite transmitter antenna comprises a first vertical loop antenna 200 having its bottom edge lying along one side of the path 202 at the exit area, and a second coplaner, vertical, loop antenna 206 mounted directly above loop antenna 200. In series at the top of antenna 200 is a transformer secondary 208, and adjacent it in series at the bottom of the second loop antenna is another transformer secondary 210. Both secondaries are transformer-coupled to transformer primary 212, which for convenience in representation is shown in the drawing as if it were spaced much further from the secondaries than it actually would be. The transmitter source 214 supplies primary 212 with transmitter signals which are coupled into the two loops in opposite senses by the transformer. The area of upper loop antenna 206 is R times greater than that of lower loop antenna 200, and secondary 208 has R times more turns than secondary 210, so that the current in the lower antenna is R times greater than in the upper loop, and ANI is the same for both antennas to provide far-field cancellation. Since the current intensity I is relatively much greater in the lower loop antenna, the near-field strength adjacent the floor is greatly enhanced, so that a tag 220 carrying a resonant tag circuit and positioned nearly flat on exit floor 202 is more readily detected.

An antenna system such as that of FIG. 10 is especially advantageous for protecting shoes from theft in a shoe store. Such thefts are typically attempted by the customer's wearing of the unpurchased shoes as he leaves the premises, in which case the tag (which may be adhered to the bottom of the sole of the shoe) is carried substantially against the floor and in a flat orientation, a position and orientation in which it is especially difficult to detect; concentration of the peak near-field strength in the region adjacent the floor makes detection of such attempted thefts much more reliable.

Also shown by way of example in FIG. 10 for completeness is a continuous-conductor two-loop receiver antenna system 230, the center of the lower loop supplying received signals to receiver 240; other types of receiver antenna systems may be used instead.

Figure 11:
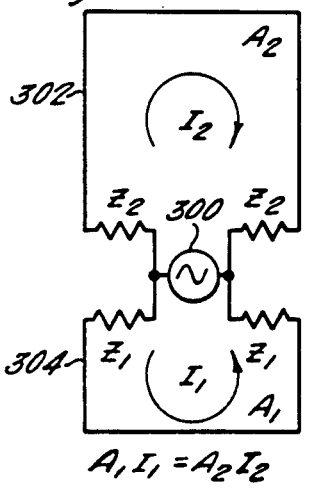
FIG. 11 is a schematic diagram showing a transformer-less form of the invention.

FIG. 11 shows a composite antenna according to the invention in which the transmitter power is directly coupled into the loops, rather than transformer-coupled as preferred. Thus the transmitter signal 300 supplies signals to the larger, upper loop 302 and the smaller, lower loop 304 in parallel, in the case of the upper loop by way of impedances $Z_2,Z_2$ and in the case of the lower loop by way of the impedances $Z_1,Z_1$. The current for each loop equals the voltage $V_s$ of source 300 divided by the total impedance in series in the loop; in calculating such current, the impedances $L_1$ and $L_2$ of the bottom and top loops should be considered as part of the total series impedances, in addition to the lumped impedances $Z_1,Z_1$ and $Z_2,Z_2$. Thus by suitable choice of $Z_1$ and $Z_2$, the oppositely-phased currents in the loops can be made such that ANI is the same for each loop, thus providing the desired higher intensity current in the lower loop for an application such as that of FIG. 10, while maintaining the desired far-field cancellation.

Figure 12:
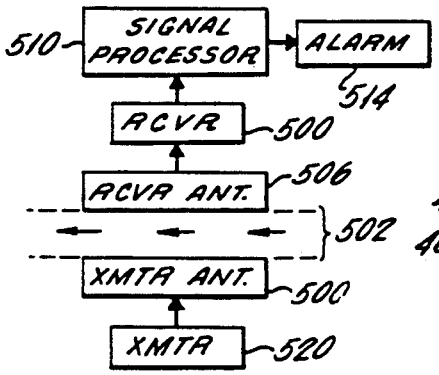
FIG. 12 is a schematic block diagram illustrating a general type of electronic surveillance system to which this invention is applicable.

FIG. 12 shows one type of system in which the invention is useful. A transmitter antenna 500 constructed according to the invention is placed on one side of the exit path 502 along which persons carrying tag-bearing articles are contrained to pass when leaving the premises. A receiver antenna 506 is placed on the directly opposite side of the path; while not necessarily like the transmitter antenna, it may be substantially the same. The EAS transmitter 520 is mounted adjacent the feed point for the transmitter antenna to supply it with RF power, and the receiver antenna supplies received power to receiver 506 and thence to a signal processor 510 to produce signals indicative of the presence of a tag, and to sound alarm 514.

Figure 13:
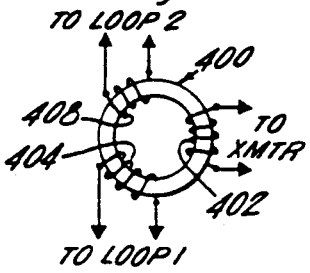
FIG. 13 is a schematic view of a form of transformer useful in some applications of the invention.

FIG. 13 illustrates one of many forms of transformer which may be used in systems such as FIGS. 9 and 10. It comprises a toroidal core 400 of ferromagnetic material having three windings, namely, a winding 402 supplied with signals from the transmitter, a first secondary 404 connected in series in one loop (e.g. The bottom loop 1) and another secondary 408 in series in the other (e.g. top) loop which is connected to the top loop 2.

In the system of FIG. 8, it was assumed that the top and bottom loops had different areas. This is not necessary, since they may have the same areas but different currents flowing in them, so long as the total of ANI for the top and bottom loops is equal and opposite to ANI for the middle loop; nor is it necessary for ANI to be the same for the top and bottom loops, so long as the sum of AIN for the two of them has the proper values to cancel the far field due to the central loop.

It is recognized that the invention may be used to compensate for the fact that in some cases one cannot practically use a fractional number of turns in a loop. For example, if a given design indicates that 2.3 turns are desirable in a given loop, in some cases one may use instead two turns and about 15% more current through the loop to achieve the desired result.

Physically, the antennas may be constituted and mounted according to known techniques, using appropriate supports and cabinetry to hold the antennas. While unshielded conductors may be used for the loops, such arrangements tend to be susceptible to local interference and to produce higher far-field strengths than are desirable, so that in some applications it is desirable to employ a conductive shield about the sides of the conductors of the loops, as shown for example in pending application Ser. No. 295,064 of P. Lizzi et al., filed Jan. 1, 1989, with the shielding broken away near the cross-over point of the loops to provide for the transformer of the present invention. Also, while in FIG. 9, for convenience the primary coil 130 is shown external to the positions of the secondaries 132,134, it will be understood that this primary will in practice generally be close to the secondaries, for example as shown in FIG. 13.

Accordingly, while the invention has been described with particular reference to specific embodiments thereof in the interest of complete definiteness, it will be understood that it may be embodied in a variety of forms diverse from those specifically shown and described, without departing from the spirit and scope of the invention.

What is claimed is:

1. In an electronic article surveillance system, an antenna system comprising:

a plurality of adjacent transmitter loop antennas, said transmitter loop antennas being configured and arranged to be responsive to the supply thereto of current of the same intensity to produce a total far-field of substantial intensity at positions remote from said transmitter loop antennas, and means for feeding said transmitter loop antennas with currents of predetermined different intensities such as to substantially cancel the total far field due to said transmitter loop antennas, while also providing a substantial net induction near field adjacent to said transmitter loop antennas, wherein the current I in at least one of said transmitter loop antennas is in a first direction with respect to the environment and the current I in the remainder of said transmitter loop antennas is in the opposite direction with respect to the environment, the sum of the product AN of the loop areas A and the number of turns N for said at least one transmitter loop antenna differing from the sum of the products AN for said remainder of said loop antennas, and the sum of the products ANI for said at least one loop antennas substantially equalling the sum of the products ANI for said remainder of said loop antennas, where I is the intensity of current in each of said loop antenna.

2. The system of claim 1, wherein the planes of the loops of all of said antenna being substantially parallel to each other.

3. The system of claim 2, wherein at least two of said antennas are disposed with their loops substantially directly one above the other.

4. The system of claim 2, wherein said means for feeding said antennas with current comprises transformer means interconnecting at least two of said loops and having a ratio of primary to secondary turns other than 1:1, so as to produce said predetermined different intensities of loop currents.

5. A composite antenna system for an electronic surveillance system, comprising:

a first loop antenna and a second loop antenna differing from each other with respect to the products of their loop areas A and the numbers N of their turns;

means coupled to said first loop antenna produce a first current therein; and transformer means coupling said first loop antenna to said second loop antenna to induce a current flow in said second loop antenna in the opposite direction from the current in said first loop antenna.

said transformer means having a turn ratio R different from one, such that the products ANI are substantially the same for said first and second loop antennas, where A is the loop area, N is the number of turns, and I is the scaler intensity of the current for each loop.

6. A composite antenna for an electronic surveillance system, comprising:

a first loop antenna and a second loop antenna, differing from each other with respect to the products ANI of their respective loop areas, number of turns and intensities of loop current;

a source of transmitter signals to be supplied to said loop antennas; and transformer means comprising a primary supplied with said transmitter signals from said source and a pair of secondaries, each in series in a different one of said loop antennas, the ratio of the number of turns of said primary to the number of turns of said secondaries differing for the two loop antennas.

7. A composite antenna system for an electronic surveillance system, comprising:

a plurality of spaced, adjacent loop antennas the loop planes of which are substantially parallel to each other, at least one of said loop antennas differing from at least another of said loop antennas with respect to the product ANI of its loop area A, its number of turns N and its current intensity I;

a source of transmitter signals to be supplied to said loop antennas for radiation therefrom;

transformer means supplied with said signals for conveying said transmitter signals to said loop antennas in different intensities and direction of flow with respect to the environment, in proportions such as to produce a substantially zero far-field strength in response to currents in all of said loop antennas.

8. A composite antenna system for an electronic article surveillance system, comprising:

a first loop antenna and a second loop antenna above and coplanar with said first antenna;

said second loop antenna having a loop area $A_2$ substantially larger than the loop area $A_1$ of said first loop antenna; and signal supply means for supplying said first loop antenna with a current having an intensity exceeding that in said second loop antenna substantially in the ratio $A_2/A_1$, the current in said loop antennas flowing in opposite directions to each other at any instant.

9. The antenna system of claim 8, wherein said signal supply means comprises a source of alternating signals to be radiated by said loop antenna, and transformer means responsive to said alternating signals from said source for supplying said alternating signals to said loop antennas in said ratio $A_2/A_1$.

10. The antenna system of claim 9, wherein said transformer means comprises a primary connected to said source and a pair of secondaries, one in series in each of said loop antennas.

* * * * *